US006665874B2

(12) United States Patent
Stolf

(10) Patent No.: US 6,665,874 B2
(45) Date of Patent: Dec. 23, 2003

(54) CUT PREVENTION FINGER GUARD

(75) Inventor: Christopher J. Stolf, Maben, MS (US)

(73) Assignee: Christopher J. Stolf, LLC, Maben, MS (US)

( * ) Notice: Subject to any disclaimer, the term of this patent is extended or adjusted under 35 U.S.C. 154(b) by 0 days.

(21) Appl. No.: 10/392,801

(22) Filed: Mar. 20, 2003

(65) Prior Publication Data

US 2003/0188369 A1 Oct. 9, 2003

Related U.S. Application Data

(60) Provisional application No. 60/370,375, filed on Apr. 5, 2002.

(51) Int. Cl.[7] ..... A41D 13/00

(52) U.S. Cl. ..... 2/21; 132/212; 602/22

(58) Field of Search ..... 2/21, 159, 163, 2/161.8, 16, 20; 30/233; 132/213, 213.1, 214, 212; 602/22

(56) References Cited

U.S. PATENT DOCUMENTS

| | | | | | |
|---|---|---|---|---|---|
| 471,252 | A | * | 3/1892 | Hanley | 602/6 |
| 2,528,456 | A | * | 10/1950 | Stevenson | 602/22 |
| 3,943,923 | A | * | 3/1976 | Scheinberg | 602/6 |
| 4,143,653 | A | * | 3/1979 | Wichman | 602/22 |
| 4,194,736 | A | * | 3/1980 | Loafman | 473/61 |
| 4,549,537 | A | * | 10/1985 | Ender | 602/21 |
| 5,048,186 | A | * | 9/1991 | Lamb et al. | 30/233 |
| 5,363,508 | A | * | 11/1994 | Kim | 2/21 |
| 5,991,918 | A | * | 11/1999 | Choate | 2/21 |

* cited by examiner

*Primary Examiner*—Tejash Patel
(74) *Attorney, Agent, or Firm*—Sutherland Asbill & Brennan, LLP

(57) ABSTRACT

A finger guard including a head, a body, and a securing device to protect a user's finger from cuts and nicks during hair cutting and to guide a hair cutting tool during cutting.

15 Claims, 3 Drawing Sheets

CUT PREVENTION FINGER GUARD

RELATED APPLICATIONS

The present application claims priority to U.S. Provisional Application Ser. No. 60/370,375, filed on Apr. 5, 2002.

TECHNICAL FIELD

The present invention relates to finger guards. More particularly, this invention relates to a finger guard that protects a finger from cuts and nicks while cutting hair with scissors, razor blades, or any hair-cutting tool.

BACKGROUND OF THE INVENTION

Cosmetologists, barbers, and other types of hair-care professionals must place their fingers in close proximity with hair cutting tools. The sharp blades from scissors, razor blades, or other hair cutting tools can cut and nick the fingers of the professional. An open wound in the professional's fingers can subject both the professional and the customer to diseases such as Dermatitis Seborrhea and Auto Immune Disorder.

There is a desire therefore for a finger guard to protect cosmetologists, barbers, and other hair-care professionals from the cuts and nicks associated with hair cutting. Both the professional and the customer will be protected from the spread of disease by avoiding wounds on the finger of the user. The finger guard will not hamper the professional's ability to cut hair but will in fact increase the speed and the accuracy of the hair cutting.

SUMMARY OF THE INVENTION

The present invention provides a finger guard for protecting the user's finger and for providing a cutting guide. According to one embodiment of this invention, a finger guard for use in cutting hair may include a head, a body, and a securing device that secures the finger guard to a user's finger. The head and the body may be made of a unitary structure. The head and the body also may be made of a malleable, cut resistant material.

Another aspect of the invention includes the head with a substantially arched shape and a body with a substantially rectangular shape. Yet another aspect of the invention is a securing device made of one or more wings that are attached to the body. The wings may be made of a malleable, cut resistant material. The finger guard may be made of aluminum and also may be coated with rubber to protect the finger guard and the hair cutting tools from damage.

According to another embodiment of the invention, the invention includes a method of protecting a user's finger from cuts during cutting of hair including the steps of placing a finger guard on an exposed area of the user's finger and securing the finger guard to the exposed area of the user's finger using the securing device. The finger guard may include a head, a body, and a securing device that secures the finger guard to the user's finger. The method may include the step of cutting hair. The method also may include the step of folding the securing device around the user's finger.

A further embodiment of the invention may be a method of protecting a user's finger from cuts during cutting of hair including the steps of placing the finger guard on an exposed area of the user's finger, bending the head and body of the finger guard to fit on the exposed area of the user's finger, and securing the finger guard to the exposed area of the user's finger using the securing device.

Other features of the present invention will become apparent upon review of the following detailed description of the preferred embodiments of the invention, when taken in conjunction with the drawings and the appended claims.

DETAILED DESCRIPTION OF THE INVENTION

Figure 1:
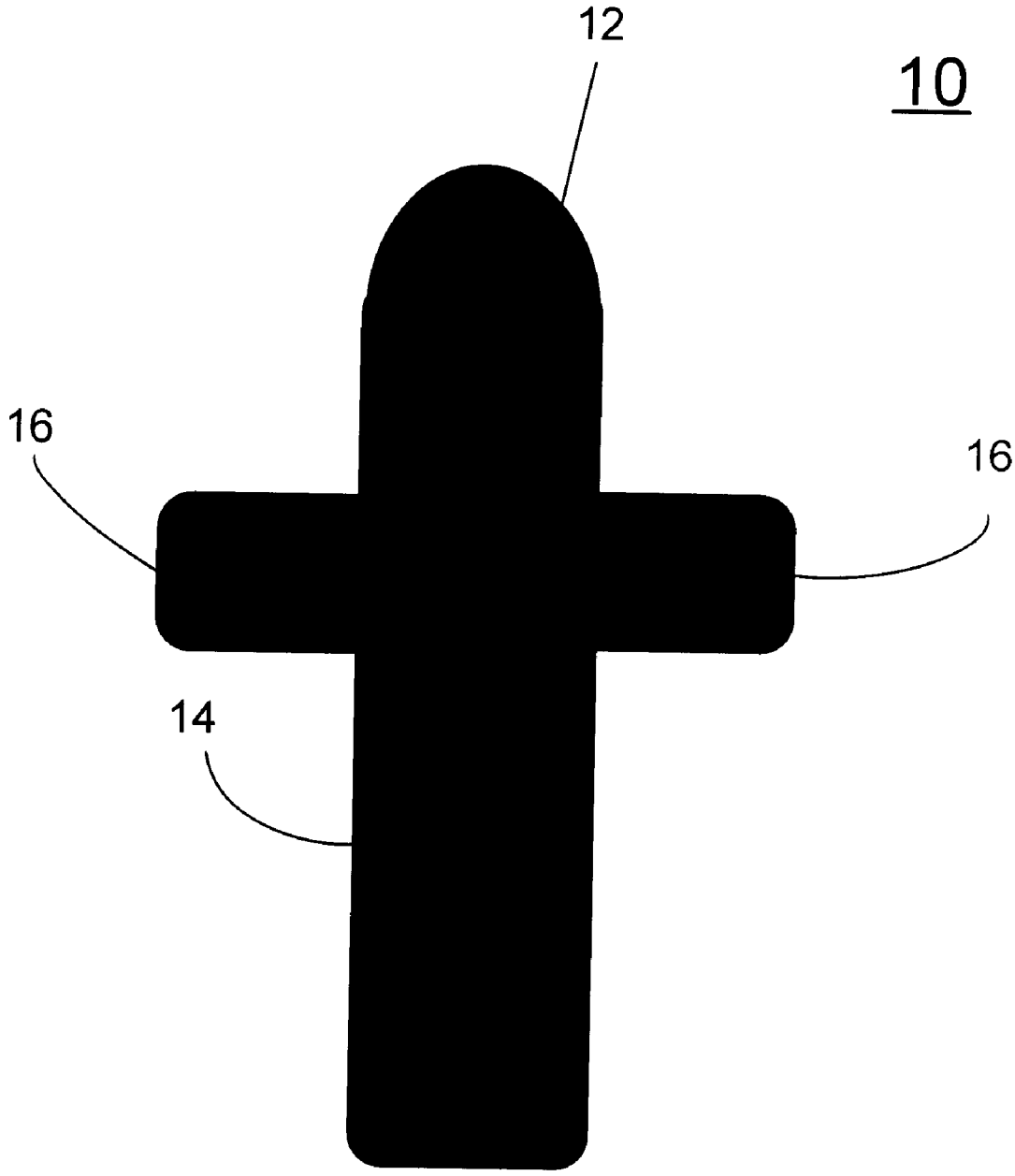
FIG. 1 is a plan view of the present embodiment of a finger guard.

Referring now in more detail to the drawings, in which like numerals indicate like elements throughout the several figures, FIG. 1 illustrates a finger guard 10 that is an embodiment of the present invention. The finger guard 10 preferably may be made of any hypoallergenic, malleable material to allow the finger guard to form fit around a finger of the user. Alternatively, the finger guard 10 may be made out of any material and preferably covered with a hypoallergenic material. The material also may be cut and puncture resistant to hair-cutting tools and may be sterilizable for repeated use. The material may include plastic, rubber, aluminum, gold, silver, lead, other metals, vinyl, laminates, composites, or any type of somewhat malleable materials. The material also may be coated with any other material, such as rubber.

The finger guard 10 may include a head 12 and a body 14. The head 12 may fit around the user's finger to allow easier access by the cutting tool to the body of the finger guard 10. The head 12 may be any shape, including substantially arched. The body 14 may be attached to the head 12. The body 14 and the head 12 may be a unitary structure or two separate structures. The body 14 may be semi-cylindrically shaped to allow the user's finger to slide into the body 14 but also may cover only the exposed portion of the finger. The body 14 also can be any shape that protects the finger, including squarely or rectangularly shaped. Both the head 12 and body 14 may be bent or shaped by the user to fit the contours of the user's finger.

The body 14 may be elongated to any length to protect the user's finger against cuts and nicks. The body 14 may extend about one inch to three inches, although any size may be used. In the present embodiment, the body 14 may extend beyond the middle and rear knuckle to protect the user's knuckles from the sharp hair cutting tools. Preventing the sharp tools from contacting the user's finger and knuckles minimizes the chance of cuts or nicks and the spread of infectious diseases. The body 14 also may act as a guide to increase the speed and accuracy of hair cutting. The user may cut along the finger guard 10 without the risk of finger cutting, thereby speeding up the hair cutting process.

Figure 3:
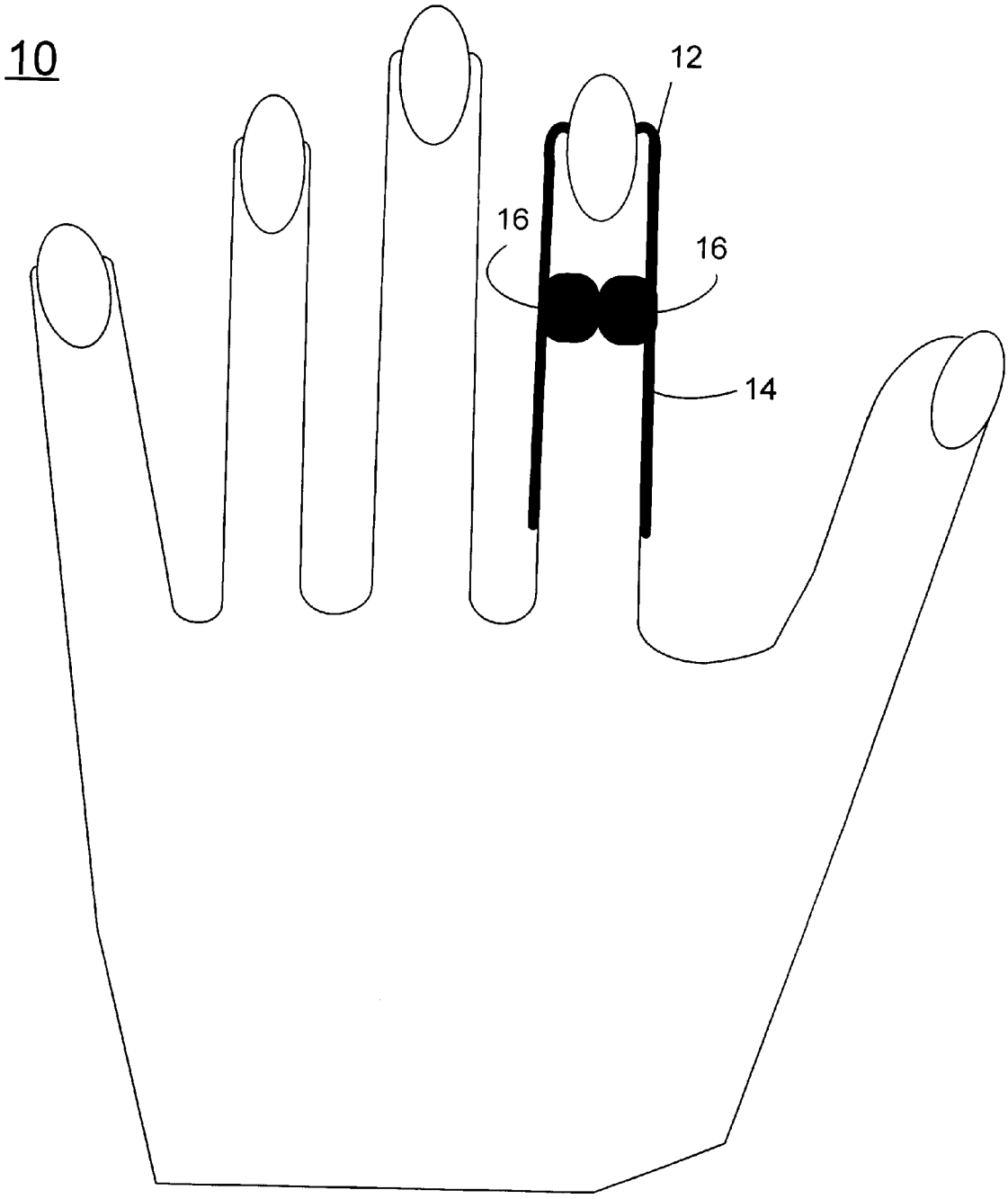
FIG. 3 is a perspective view of the securing device of the present embodiment securing the finger guard on a user's finger.

The finger guard 10 also may include a securing device to secure the body to a user's finger. One or more wings 16 may be used as a securing device. The wings 16 may extend perpendicularly from the body. As illustrated in FIG. 3, the wings 16 may be made of a malleable material so that the wings 16 can be folded around the body 14 to secure the body 14 to the finger. Any device that secures the body 14 to the user's finger is contemplated, such as straps, adhesive, or a form fitted body 14 that is tight enough to prevent slipping. The wings 16 may extend about one-half of an inch to two inches, although any size may be used.

Figure 2:
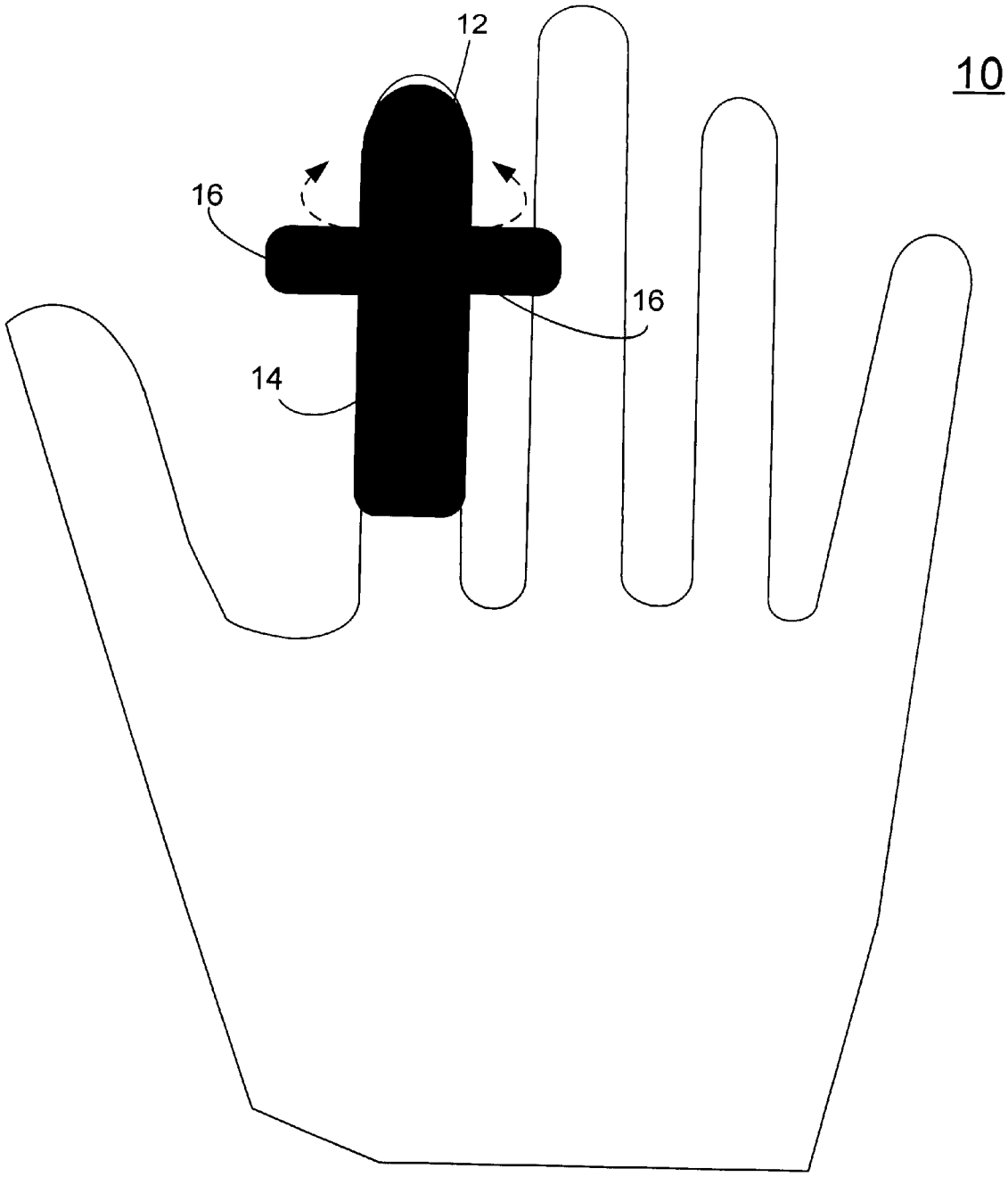
FIG. 2 is a perspective view of the present embodiment on a user's finger.

According to one embodiment of the present invention and as illustrated in FIG. 2, the finger guard 10 may include the head 12, the body 14, and two wings 16 as the securing device. The head 12, the body 14, and the wings 16 may be made of aluminum and may also be coated with rubber to protect the finger guard 10 and the cutting tools from damage during use. The head 12 and the body 14 may be about one-eighth of an inch thick. Any thickness, however, may be used. The head 12 may be approximately one inch long and substantially arched. The body 14 may extend approximately two inches from the head 12 and be substantially rectangular. However, any appropriate sizes and shapes of the head 12 and the body 14 are contemplated.

The head 12 and the body 14 in the present embodiment may be a unitary structure that may be positioned about the finger and may be formed by the user to better fit upon the finger. Forming may be accomplished by bending the head 12 and body 14 along their longitudinal axes. The wings 16 may extend perpendicularly from the body 14 and may be about one-and-one-quarter inches long and about three-quarters of an inch wide. The wings 16 also may extend at an angle from the body 14. Any size wings appropriate for securing the finger guard is contemplated. As shown in FIGS. 2 and 3, the wings 16 may fold around the finger to secure the head 12 and body 14 to the finger.

The user has the ability to position the finger guard 10 in any orientation. For instance as shown in FIG. 2, if the user cuts from the fingertip towards the knuckles, the head 12 may be positioned towards the finger tips so that the arch in the head 12 allows for easier access to the body 14. If the user prefers to cut in a direction from the knuckles to the finger tip, the arched head 12 may be positioned towards the rear knuckle instead of the finger tip. The head 12 and body 14 may also be positioned to protect any portion of the finger exposed to the scissors or other cutting tools—i.e., top of the finger, side of the finger, bottom of the finger, or any combination thereof. The finger guard also may be used on any finger, and any plurality of finger guards may be used concurrently.

The present invention is not limited to the dimensions or materials in the present embodiment. One of ordinary skill in the art would appreciate that any size finger guard of any appropriate material that fits on a finger is contemplated.

It should be apparent that the foregoing relates only to the preferred embodiments of the present invention and that numerous changes and modifications may be made herein without departing from the spirit and scope of the invention as defined by the following claims and the equivalents thereof.

I claim:

1. A finger guard for use in cutting hair, comprising:

a head;

a body attached to said head; and a securing device attached to said body that secures said body to a user's finger, wherein said securing device is made of a malleable material that comprises at least two wings, wherein a first wing extends from said body in a first direction and a second wing extends from said body in a second direction substantially opposite from said first direction of said first wing such that said first and second wings is folded to secure said head and body to said user's finger.

2. The finger guard as in claim 1, wherein said head and said body comprise a unitary structure.

3. The finger guard as in claim 1, wherein said head, said body, and said securing device comprise a unitary structure.

4. The finger guard as in claim 1, wherein said head comprises a malleable material.

5. The finger guard as in claim 1, wherein said head comprises a puncture and cut resistant material.

6. The finger guard as in claim 1, wherein said head comprises a substantially arched shape.

7. The finger guard as in claim 1, wherein said body comprises a malleable material.

8. The finger guard as in claim 1, wherein said body comprises a puncture and cut resistant material.

9. The finger guard as in claim 1, wherein said body comprises a substantially rectangular shape.

10. The finger guard as in claim 1, wherein said head, said body, and said securing device comprise aluminum.

11. The finger guard as in claim 1, wherein said head, said body, and said securing device comprise a rubber coating.

12. A method of protecting a user's finger from cuts during cutting of hair comprising:

placing a finger guard on an exposed area of the user's finger, wherein said finger guard comprises a head a body, and a securing device, wherein said securing device is made of a malleable material that comprises at least two wings, wherein a first wing extends from said body in a first direction and a second wing extends from said body in a second direction substantially opposite from said first direction of said first wing; and securing said finger guard to the exposed area of the user's finger using said securing device by folding said first and second wings around said user's finger.

13. The method as in claim 12, further comprising cutting hair.

14. The method as in claim 12, wherein said securing step comprises folding said securing device around the user's finger.

15. A method of protecting a user's finger from cuts during cutting of hair using a finger guard having a head, a body, and a securing device, comprising:

placing said finger guard on an exposed area of the user's finger, wherein said finger guard comprises a head, a body, and a securing device, wherein said securing device is made of a malleable material that comprises at least two wings, wherein a first wing extends from said body in a first direction and a second wing extends from said body in a second direction substantially opposite from said first direction of said first wing;

bending said head and said body of said finger guard to fit on the exposed area of the user's finger; and securing said finger guard to the exposed area of the user's finger using said securing device by folding said first and second wings around said user's finger.

* * * * *